US011028604B2

(12) United States Patent
Van Der Leest et al.

(10) Patent No.: US 11,028,604 B2
(45) Date of Patent: Jun. 8, 2021

(54) REINFORCED MASONRY WALL

(71) Applicants: SEALTEQ | GROUP B.V., Stadskanaal (NL); OOSTERHOF HOLMAN INFRA B.V., Grijpskerk (NL)

(72) Inventors: Martin Christiaan Van Der Leest, Stadskanaal (NL); Peter Westra, Muntendam (NL)

(73) Assignees: SEALTEQ I GROUP B.V., Stadskanaal (NL); OOSTERHOF HOLMAN INFRA B.V., Grijpskerk (NL)

( * ) Notice: Subject to any disclaimer, the term of this patent is extended or adjusted under 35 U.S.C. 154(b) by 170 days.

(21) Appl. No.: 15/567,884

(22) PCT Filed: Apr. 20, 2016

(86) PCT No.: PCT/NL2016/050280
§ 371 (c)(1),
(2) Date: Oct. 19, 2017

(87) PCT Pub. No.: WO2016/171555
PCT Pub. Date: Oct. 27, 2016

(65) Prior Publication Data

US 2018/0298627 A1 Oct. 18, 2018

(30) Foreign Application Priority Data

Apr. 20, 2015 (NL) ..... 2014680

(51) Int. Cl.
*E04B 1/98* (2006.01)
*E04G 23/02* (2006.01)
(Continued)

(52) U.S. Cl.
CPC ..... *E04G 23/0218* (2013.01); *E04B 2/02* (2013.01); *E04C 5/073* (2013.01); *E04H 9/027* (2013.01);
(Continued)

(58) Field of Classification Search
CPC ..... E04G 23/0218; E04G 2023/0251; E04C 5/073; E04H 9/027
See application file for complete search history.

(56) References Cited

U.S. PATENT DOCUMENTS 5,640,825 A 6/1997 Ehsani et al.
5,649,398 A 7/1997 Isley, Jr. et al.
(Continued)

FOREIGN PATENT DOCUMENTS

CN 206143827 U 5/2017
DE 2510262 A1 9/1976
(Continued)

OTHER PUBLICATIONS

Sika Limited, Sikadur-30 Product Data Sheet, "Adhesive for bonding Carbon Fibre & Steel Reinforcement", Mar. 23, 2016, 10 pages.
(Continued)

*Primary Examiner* — Basil S Katcheves
(74) *Attorney, Agent, or Firm* — Pearne & Gordon LLP

(57) ABSTRACT

A masonry wall is provided with a plurality of passageways. At least one reinforcement member is provided in each of the passageways. The reinforcement members include a first group of reinforcement members each having a centre line on the first side of a midplane of the wall and a second group of reinforcement members each having a centre line on the second side of the midplane. The passageways include slots that are open horizontally to the first side of the wall only. The second group of reinforcement members are arranged in passageways located spaced from the second wall surface
(Continued)

opposite of the first wall surface. The reinforcement members in the passageways are each embedded in an adhesive substance bonded to the reinforcement members and to an inner surface of the passageway in which the reinforcement member is provided.

9 Claims, 2 Drawing Sheets

(51) Int. Cl.
*E04B 2/02* (2006.01)
*E04C 5/07* (2006.01)
*E04H 9/02* (2006.01)

(52) U.S. Cl.
CPC .. *E04B 2103/02* (2013.01); *E04G 2023/0251* (2013.01)

(56) References Cited

U.S. PATENT DOCUMENTS

| | | | | |
|---|---|---|---|---|
| 5,894,003 | A | 4/1999 | Lockwood | |
| 6,402,427 | B1 | 6/2002 | James | |
| 6,416,693 | B1 * | 7/2002 | Lockwood | E04G 23/0218 156/94 |
| 6,418,684 | B1 * | 7/2002 | Morton | E04G 23/0218 52/293.2 |
| 6,662,516 | B2 | 12/2003 | Vandehey et al. | |
| 8,925,268 | B2 | 1/2015 | Tourneur et al. | |
| 2002/0170651 | A1 | 11/2002 | Edwards | |
| 2005/0188648 | A1 * | 9/2005 | Bayraktar | E04G 23/0218 52/742.16 |
| 2006/0010826 | A1 * | 1/2006 | Canteri | E04B 1/648 52/741.4 |
| 2011/0036029 | A1 | 2/2011 | Tourneur et al. | |
| 2011/0146196 | A1 * | 6/2011 | Moroschan | E04B 2/42 52/742.13 |
| 2013/0340359 | A1 * | 12/2013 | Lichtenfeld | E04H 9/027 52/167.1 |
| 2014/0099456 | A1 | 4/2014 | Raghavendran et al. | |
| 2015/0322671 | A1 * | 11/2015 | Lichtenfeld | E04B 1/26 52/167.1 |
| 2016/0251865 | A1 * | 9/2016 | Martina | E04G 23/0218 52/223.4 |

FOREIGN PATENT DOCUMENTS

| | | | |
|---|---|---|---|
| DE | 20018767 | U1 | 3/2001 |
| EP | 0034224 | A2 | 8/1981 |
| EP | 1170440 | A1 | 1/2002 |
| EP | 2295675 | A1 | 3/2011 |
| FR | 2562927 | A1 | 10/1985 |
| GB | 2357108 | A | 6/2011 |
| JP | 6144951 | A | 6/2017 |
| KR | 20010088712 | A | 9/2001 |
| KR | 101057667 | B1 | 8/2011 |
| KR | 20120037130 | A | 4/2012 |
| KR | 20120037132 | A | 4/2012 |

OTHER PUBLICATIONS

BASF Technical Data Guide, "MasterBrace Composite Laminates and Rods", Maintenance of Concrete, vol. 3, Form No. 1031102, Apr. 2015, 4 pages.
BASF Technical Data Guide, "MasterEmaco ADH 1420", Maintenance of Concrete, vol. 3, Form No. 1019957, Jul. 2014, 4 pages.
BASF Technical Data Guide, "MasterEmaco ADH 327 RS", Maintenance of Concrete, vol. 3, Form No. 1019342, Mar. 2016, 4 pages.
Mapei, "Adesilex PG1, Adesilex PG2, Two-Compartment Thixotropic Epoxy Adhesives for Structural Bonding", Great Britain, 2016, 4 pages.
S&P Resin, "Technical Data Sheet—S&P Resin 220 Epoxy Adhesive", Feb. 2013, 3 pages.
Konthesingha, K.,et al., "Earthquake Protection of Masonry Shear Walls Using Fibre Reinforced Polymer Strengthening", University of Newcastle Australia, Oct. 2012, 411 pages.
Tumilian, G., et al., "FRP Composites for Masonry Retrofitting, Review of Engineering Issues, Limitations, and Practical Applications", Structure, May 2009, pp. 12-14.
XP-002763704, "Epoxonic EX 2840", Epdxonic GMBH Reaktionsharzsvsteme, Jan. 2014, 2 pages.
XP-002763703, "Epoxonic 309", Epdxonic GMBH Reaktionsharzsvsteme, Mar. 2014, 3 pages.
Dai, J.G., et al., "Flexural Strengthening of RC Beams Using Externally Bonded FRP Sheets Through Flexible Adhesive Bonding", Proceedings of the International Symposium on Bond Behaviour of FRP in Structures (BBFS 2005), International Institute for FRP in Construction, 2005, pp. 205-213.
Derkowski, W., et al., "CFRP Strengthening of Bent RC Beams Using Stiff and Flexible Adhesives", Technical Transactions Civil Engineering, vol. 1-B, 2013, pp. 37-52.
Dizhur, D., et al., "Pullout Strength of NSM CFRP Strips Bonded to Vintage Clay Brick Masonry", Elsevier, Engineering Structures, vol. 69, 2014, pp. 25-36.
Kashyap, J., et al., "Debonding Resistance of FRP-to-Clay Brick Masonry Joints", Elsevier, Engineering Structures, vol. 41, 2012, pp. 186-198.
Konthesingha, K.M.C., et al., "Bond Behaviour of NSM FRP Strips to Modern Clay Brick Masonry Prisms Under Cyclic Loading", 11th Canadian Masonry Symposium, Toronto, Canada, May 31-Jun. 3, 2009, pp. 1-10.
Kwiecien, A., "Stiff and Flexible Adhesives Bonding CFRP to Masonry Substrates—Investigated in Pull-Off Test and Single-Lap Test", Elsevier, Archives of Civil and Mechanical Engineering, vol. 12, 2012, pp. 228-239.
Willis, C.R., et al., "Damaged Masonry Walls in Two-Way Bending Retrofitted with Vertical FRP Strips", Elsevier, Construction and Building Materials, vol. 23, 2009, pp. 1591-1604.
Barbieri, et al. "Pull out of FRP reinforcement from masonry pillars: Experimental and numerical results." Elsevier Journal—Composites: Part B, 69 (2015), p. 516-525, available online Oct. 20, 2014. 10 pages.
Caggegi, et al. "Experimental global analysis of the efficiency of carbon fiber anchors applied over CFRP strengthened bricks." Elsevier Journal—Construction and Building Materials, 53 (2014), pp. 203-212, available online Dec. 21, 2013. 10 pages.
Camli, et al. "Strength of carbon fiber reinforced polymers bonded to concrete and masonry." Elsevier Journal—Construction and Building Materials, 21 (2007), 1431-1446, available online Sep. 8, 2006. 16 pages.
Capozucca, R. "Behaviour of CFRP Sheets Bonded to Historical Masonry." Asia-Pacific Conference on FRP in Structures (APFIS 2007), 2007. 6 pages.
Capozucca, Roberto. "Experimental FRP/SRP—historic masonry delamination." Elsevier Journal—Composite Structures, 92 (2010), p. 891-903, available online Sep. 19, 2009. 13 pages.
Carozzi, et al. "Calibration of end-debonding strength model for FRP-reinforced masonry." Elsevier Journal—Composite Structures, 120 (2015), pp. 366-377, available online Sep. 23, 2014. 12 pages.
Carrara, et al. "Debonding behavior of ancient masonry elements strengthened with CFRP sheets." Elsevier Journal—Composites: Part B, 45 (2013), 800-816, available online May 1, 2012. 11 pages.
Sika Services AG, Switzerland. "Externally bonded FRP reinforcement for RC structures." Technical Report—Bulletin 14. Jul. 2001. 139 pages.
Faella, et al. "Bond behaviour of FRP strips glued on masonry: Experimental investigation and empirical formulation." Elsevier Journal—Construction and Building Materials, 31 (2012), pp. 353-363, available online Feb. 7, 2012. 11 pages.
Fagone, et al. "The efficiency of mechanical anchors in CFRP strengthening of masonry: An experimental analysis." Elsevier Journal—Composites: Part B, 64 (2014), pp. 1-15, available online Apr. 18, 2014. 15 pages.

(56) References Cited

OTHER PUBLICATIONS

Grande, et al. "Bond behaviour of CFRP laminates glued on clay bricks: Experimental and numerical study." Elsevier Journal—Composites: Part B, 42 (2011), pp. 330-340, available online Oct. 7, 2010. 11 pages.
Hosseini, et al. "Influence ofbondingtechniqueonbondbehaviorofCFRP-to-claybrick masonry joints: masonry joints: Experimental study using particle image velocimetry (PIV)." Elsevier Journal—International Journal of Adhesion & Adhesives, 59 (2015), pp. 27-39, available online Feb. 3, 2015. 13 pages.
Kwiecień, Arkadiusz. "Highly Deformable Polymers for Repair and Strengthening of Cracked Masonry Structures." GSTF International Journal of Engineering Technology (JET) vol. 2 No. 1, May 2013. 15 pages.
Maljaee, et al. "Bond Performance in NSM-Strengthened Masonry Brick." 9th National Congress of Experimental Mechanics. Oct. 15-17, 2014. 8 pages.
Oliveira, et al. "Experimental Bond Behavior of FRP Sheets Glued on Brick Masonry" Journal of Composites for Construction, 2011, 15(1), pp. 32-41, Jan./Feb. 2011. 10 pages.
Panizza, et al. "Bond behaviour of CFRP and GFRP laminates on brick masonry." Structural Analysis of Historic Construction. 2008. 8 pages.
Peterson, et al. "Bond Behavior of Near-Surface Mounted FRP Strips Bonded to Modern Clay Brick Masonry Prisms: Influence of Strip Orientation and Compression Perpendicular to the Strip." Journal of Composites for Construction, 2009, 13(3), pp. 169-178, May/Jun. 2009. 10 pages.
Rotunno, et al. "Experimental Study of Bond Behavior of CFRP-to-Brick Joints." Journal of Composites for Construction, 2015, 19(3). 14 pages.
Valluzzi, et al. "Round Robin Test for composite-to-brick shear bond characterization." Material and Structures (2012) 45, pp. 1761-1791, published online Nov. 16, 2012. 31 pages.
Willis, et al. "Bond behaviour of FRP-to-clay brick masonry joints." Elsevier Journal—Engineering Structures, 31 (2000), pp. 2580-2587, available online Jun. 26, 2009. 8 pages.
Xia, et al. "Debonding Mechanisms in FRP Plated Unreinforced Masonry Under Out-of-Plane Loading." Advances in Structural Engineering vol. 9 No. 5. 2006. 19 pages.

* cited by examiner

REINFORCED MASONRY WALL

FIELD AND BACKGROUND OF THE INVENTION

The invention relates to a reinforced masonry wall and to a method of reinforcing a masonry wall, in particular for increasing its resistance against earthquakes. A masonry wall is built from individual units laid in and bound together by mortar. Brick and concrete block are the most common types of masonry units, but stone, marble, granite, travertine, limestone, cast stone, glass block, stucco, tile, and cob are also common. The walls may be either weight-bearing or a veneer. Although masonry is generally a highly durable form of construction and masonry has high compressive strength under vertical loads, it has low tensile strength (against twisting or stretching) unless reinforced. Unreinforced masonry buildings are highly vulnerable to damage during earthquakes, due to their high mass, limited ductility and low tensile strength.

"*FRP Composites for Masonry Retrofitting*" Tumilian et al., Structure magazine, May 2009, p. 12-14 describes reinforcing existing masonry with fibre reinforced plastic (FRP) strips. According to this document, strengthening of masonry walls for seismic and wind loads may require FRP placement on both sides of the wall, to provide flexural resistance against both inward and outward loads. It is also contemplated that, for some exterior walls that are part of the building envelope, placing FRP on both sides may not be possible due to field constraints (e.g. presence of the backup wall of a cavity wall system) and that similar constraints may exist for brick walls in historical buildings. In this case, even though both wall sides are accessible, the exterior side may be "untouchable" because the FRP would disrupt the facade appearance unless outside-face bars are concealed in the bed joints.

In "*Earthquake Protection of Masonry Shear Walls Using Fibre Reinforced Polymer Strengthening*", K. M. C. Konthesingha, PhD-thesis, School of Engineering, The University of Newcastle, Australia, 2012, cyclic loading was used to investigate the cyclic bond behaviour of FRP to solid clay brick masonry. For instance, pull test specimens, each consisting a four brick high stack bonded prism reinforced with 15 mm wide unidirectional pultruded carbon fibre reinforced plastic (CFRP) strips inserted in vertical slots cut into the brick units using a brick cutting saw. The FRP strips were then glued into the slots with a two-part epoxy adhesive. The cross section of the vertical slots was 20 mm deep and 6 mm wide. The strengthening reinforcement was applied only on one side of the wall because in practice it is usually not possible to access both sides of an existing wall.

Reinforcing walls with FRP strips is also disclosed in U.S. Pat. No. 5,894,003 and Korean patents 101240283, 1004432318 and 101057667.

European patent application 1 170 440 discloses strengthening a stone or brick masonry wall, especially with regard to seismic activity, by applying a laminate superficial strengthening membrane made of a composite material of glass or carbon fibres soaked in an epoxy resin, and made from an adhesive gauze, a distribution element, and a covering web, to one or both surfaces of the wall.

SUMMARY OF THE INVENTION

It is an object of the invention to provide a solution that allows reinforcing a wall of masonry, in particular in an existing building, to increase the resistance of the wall against earthquakes, without access to or leaving traces on one wall surface of the wall.

According to the invention, this object is achieved by providing a wall of a building, wherein:

the wall is a masonry wall built from individual units laid in and bound together by mortar;

the wall has first and second wall surfaces on opposite first and second sides of the wall and a midplane centrally between and parallel to the opposite wall surfaces;

a plurality of passageways is provided in the wall, the passageways each being elongated in a longitudinal direction;

at least one reinforcement member is provided in each of the passageways, the reinforcement members being elongated in the longitudinal direction of the passageways;

the reinforcement members include a first group of reinforcement members each having a centre line on the first side of the midplane and a second group of reinforcement members each having a centre line on the second side of the midplane;

the passageways include slots;

the slots are open horizontally to the first side of the wall only;

the second group of reinforcement members are arranged in passageways located spaced from the second wall surface; and the reinforcement members in the passageways are each embedded in an adhesive substance, the adhesive substance being bonded to each of the reinforcement members and to an inner surface of the passageway in which the reinforcement member is provided.

Because in such a wall, also passageways on a second side of a midplane of the wall are located spaced from the second wall surface opposite of the first wall surface, reinforcements can be provided also on the second side of the neutral midplane of the wall, without requiring access to or through the wall surface on the second side of the wall and can accordingly be made without leaving any traces on the second side of the wall and also if the second side of the wall is inaccessible, for instance because it is in a cavity of a cavity wall.

The invention can also be embodied in a method of reinforcing a masonry wall of a building, the wall being built from individual units laid in and bound together by mortar and having first and second wall surfaces on opposite first and second sides of the wall and a midplane centrally between and parallel to the opposite wall surfaces, the method including:

making a plurality of passageways in the wall by removing wall material, the passageways each being elongated in a longitudinal direction, the passageways including slots, wherein the slots are open horizontally to the first side of the wall only;

arranging at least one reinforcement member in each of the passageways, the reinforcement members being elongated in the longitudinal direction of the passageways, the reinforcement members including a first group of reinforcement members each having a centre line on the first side of the midplane and a second group of reinforcement members each having a centre line on the second side of the midplane, the second group of reinforcement members being arranged in passageways located spaced from the second wall surface; and embedding the reinforcement members in the passageways in an adhesive substance injected in the passageways, the adhesive substance bonding to each of the reinforcement members and to an inner surface of the passageway in which the reinforcement member is provided.

According to another aspect of the invention, a wall of a building is provided, wherein:

the wall is a masonry wall built from individual units laid in and bound together by mortar;

a plurality of passageways is provided in the wall, the passageways each being elongated in a longitudinal direction;

at least one reinforcement member is provided in each of the passageways, the reinforcement members being elongated in the longitudinal direction of the passageways;

the reinforcement members in the passageways are each embedded in an adhesive substance, the adhesive substance being bonded to each of the reinforcement members and to an inner surface of the passageway in which the reinforcement member is provided; and the adhesive substance has an elongation at break of at least 40% and preferably at least 50% (DIN 53544) and a hardness at room temperature of at most 100 and preferably at most 90 Shore A.

Because the adhesive substance is relatively soft and has a large elongation at break, it can accommodate relatively large deformations of the wall, without causing cracking of masonry along the reinforcing members. Thus, even if the wall deforms to an extent that some cracking occurs, the reinforcing members effectively hold the wall together so that complete collapse of the wall is counteracted. Such a failure mode in which complete collapse or other failure of a wall occurs only at loads much larger than loads at which first cracks occur is of particular advantage for avoiding casualties in the event of an earthquake.

According to yet another aspect of the invention, a masonry wall of a building is provided, which wall is built from individual units laid in and bound together by mortar, the wall further including a stabilizing layer covering a vertical surface of the wall, the stabilizing layer being composed of a matrix material and fibres embedded in the matrix material, the matrix material adhering to the first wall surface, wherein the matrix material has an elongation at break of at least 250% and preferably at least 300% at 24° C. (ASTM D412) and a hardness of at most 120 and preferably at most 110 Shore A or at most 60 and preferably at most 50 Shore D (ASTM D2240).

Because the matrix material of a composite layer covering a surface of the wall is relatively soft and has a large elongation at break, it can accommodate relatively large deformations of the wall, without debonding from the masonry. Thus, even if the wall deforms to an extent that some cracking occurs, the composite layer effectively holds the wall together so that complete collapse of the wall is counteracted. Such a failure mode in which complete collapse or other failure of a wall occurs only at loads much larger than loads at which first cracks occur is of particular advantage for avoiding casualties in the event of an earthquake.

Optional features of the invention are set forth in the dependent claims. Further features, effects and details of the invention are described in the detailed description with reference to examples of walls according to the invention shown in the drawings.

DETAILED DESCRIPTION

The invention is first described with reference to a first example of a wall according to the invention shown in FIG. 1.

Figure 1:
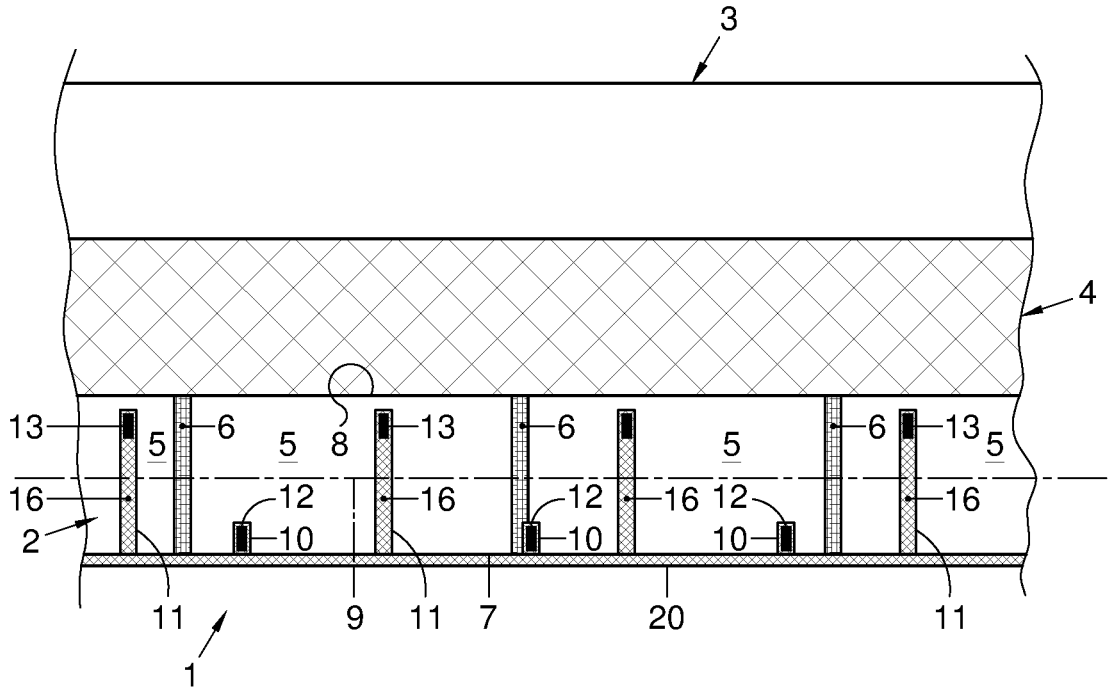
FIG. 1 is a horizontal cross-sectional view of a portion of a first example of a wall according to the invention.

In FIG. 1, a cavity wall 1 including a load bearing inner wall 2, a veneer wall 3 and a cavity 4 filled with insulating foam is shown. In this example, the load bearing inner wall 2 is an example of a reinforced wall according to the invention.

The inner wall 2 is a masonry wall built from individual bricks 5 laid in and bound together by mortar 6. The inner wall 2 has first and second wall surfaces 7, 8 on opposite first and second sides of the inner wall 2 and a midplane 9 centrally between and parallel to the opposite wall surfaces 7, 8.

Passageways 10, 11 are provided in the inner wall 2. The passageways 10, 11 are each elongated in a longitudinal direction. The longitudinal direction is preferably oriented substantially vertically. Vertical reinforcement has been shown to provide greater increases in strength and ductility in walls subjected to in-plane shear loading and to be most effective for strengthening against out of plane bending. In the present example, the passageways 10, 11 are in the form of slots. Such slots can be provided quickly, efficiently and accurately by sawing, e.g. using a diamond saw.

A reinforcement member 12, 13 is provided in each of the passageways 10, 11. The reinforcement members 12, 13 are elongated in the longitudinal direction of the passageways 10, 11. In this and other embodiments, the reinforcement members 12, 13 preferably each extend over the entire length of the passageway 10, 11 in which they are arranged. However, due to manufacturing tolerances, availability of reinforcement members in a limited number of pre-cut sizes, reinforcement members 12, 13 will typically be slightly to substantially (up to 1, 5, 10 or 20 cm) shorter than the length of the passageway 10, 11 in which they are arranged.

In this and other embodiments, the passageways 10, 11 are preferably of a length extending from one end of the wall to the opposite end (e.g. from the top to the bottom) so that the wall 2 is reinforced over its entire height (or width). The passageways may end at a small distance (e.g. up to 5, 10 or 20 cm) of the ends of the wall, for instance to avoid cutting into the floor or the ceiling or if cutting equipment is unable to reach into corners between the wall and a ceiling or floor.

The reinforcement members include a first group of reinforcement members 12 each having a centre line (i.e. line in longitudinal direction of the reinforcement member intersecting centres of the reinforcement member cross-sections) on the first side of the midplane 9 and a second group of reinforcement members 13 each having a centre line on the second side of the midplane 9. Thus, reinforcement members 12, 13 are provided on both sides of the midplane 9 of the inner wall 2, so that reinforcement members 12, 13 can be loaded with tensile loads transferred thereto on both sides of the midplane 9. This is particularly advantageous in the event of earthquakes oscillating with a substantial directional component in a direction transverse to the wall 1, which causes the walls 2, 3 to be subjected to oscillating bending loads.

The passageways 10, 11 are open (disregarding items and substances inserted therein) horizontally to the first side 7 of the inner wall 2 only and the second group of reinforcement members 13 are arranged in passageways 11 that are located spaced from the second wall surface 8. Thus, the slots 10, 11 can be made even if, as in the present example, the second surface of the wall 2 is not accessible because it bounds a cavity of a cavity wall. There may also be other reasons why making passageways from the side of the second wall surface 8 is preferably avoided or impossible. The second wall surface may for instance be difficult to reach due to a location high above the ground or due to implements such as stairs or a kitchen mounted thereto. Also restoring the outer appearance of the second wall surface after cutting passageways therein may be difficult, expensive or even impossible (e.g. in a historic building).

The reinforcement members 12, 13 in the passageways 10, 11 are each embedded in an adhesive substance 16 (adhesive substance in the passageways 10 holding reinforcement members 12 of the first group not shown). The adhesive substance 16 is bonded to each of the reinforcement members 12, 13 and to an inner surface of the passageway 10, 11 in which the reinforcement member 12, 13 is provided. Thus loads exerted onto the inner wall 2 that would cause deformation of the inner wall 2 are effectively transferred to the reinforcement members 12, 13, which thus counteract deformation of the inner wall 2. In particular tensile loads are thus absorbed particularly effectively by the reinforcement members 12, 13, so that the masonry is effectively protected from being damaged when subjected to tensile loads, for instance as a result of bending loads caused by oscillations of the ground in an earthquake. Also the failure mode of the wall in the event of damage exhibits a much wider load range between initial damage (e.g. cracks) and full collapse of the wall, which is of particular importance for avoiding casualties due to suddenly falling floors and roofing in the event of an earthquake.

In this and other embodiments, the adhesive substance preferably has an elongation at break of at least 40% and preferably at least 50% (DIN 53544) and a hardness at room temperature of at most 100 and preferably at most 90 Shore A and at least 50 to 60 Shore. Because the adhesive substance is relatively soft and has a large elongation at break, it can accommodate relatively large deformations of the wall, without causing cracking of masonry along the reinforcing members. Thus, even if the wall deforms to an extent that some cracking occurs, the reinforcing members effectively hold the wall together so that complete collapse of the wall is counteracted. Such a failure mode in which complete collapse or other failure of a wall occurs only at loads much larger than loads at which first cracks occur is of particular advantage for avoiding casualties in the event of an earthquake. Adhesion of the adhesive substance is preferably greater than 1 $N/mm^2$ (DIN 52455) and tensile strength is preferably greater than 2 $N/mm^2$ (DIN 52455). Adhesive substances fulfilling these specifications are commercially available. It is noted that although using such an adhesive substance is particularly advantageous in the relatively deep passageways for holding the reinforcement members of the second group, an adhesive substance that is relatively soft and has a large elongation at break is also advantageous if passageways are provided on the first side of the midplane only.

If, as in the present example, the reinforcement members 13 of the second group are also arranged in slots 11 that are open horizontally to the first wall surface 7, the slots 11 having a depth extending from the first wall surface 7 to beyond the midplane 9 and the reinforcement members 13 of the second group are arranged adjacent to a side of the slots 11 most remote from the first wall surface 17, the passageways 11 for holding the reinforcement members 13 on the second side of the midplane 9 can be made easily and by making incisions through the same first wall surface 7 in which also the slots 10 for holding the reinforcement members 12 on the first side of the midplane 9 are cut. The slots 10, 11 for receiving the reinforcement members 12, 13 of the first and second groups can in principle be made using the same cutting tools.

The reinforcement members 12 of the first group are arranged in a first group of slots 10 having a first depth and the slots 11 in which the reinforcement members 13 of the second group are arranged are slots 11 of a second group having a second depth larger than the first depth. Thus, the slots 10, 11 for receiving the reinforcement members 12, 13 of the first and second groups can simply be made by for instance alternatingly cutting deep and shallow grooves in the first surface of the inner wall 2.

Because the space in the slots 10, 11 remaining after the reinforcement members 12, 13 have been inserted is filled with the adhesive substance, weakening of the wall 2 due to the interruption of masonry by the slots 10, 11 is at least counteracted. Also, the reinforcement members 12, 13 in the slots reduce deformation of the wall 2 in particular in the area of the slots 10, 11, so that failure by cracking along the slots 10, 11 occurs at very high shock loads only.

A stabilizing layer 20 covers the first wall surface 7. The stabilizing layer 20 is composed of a matrix material and fibres such as glass fibres in a woven or non-woven pattern embedded in the matrix material. The matrix material adheres to the first wall surface 7. The stabilizing layer 20 is particularly effective for counteracting the formation of cracks along the reinforcement members of the first group 12 when the wall 2 is heavily loaded with tensile stress on the first side of the midplane 9, e.g. during bending loads with the first side 7 located on the outside of the induced bend. If cracks do occur, the stabilizing layer effectively holds the wall 2 together so that complete collapse of the wall is counteracted. Another advantage of the stabilizing layer is that it constitutes a bridging interconnecting and mutually fixing wall portions on opposite sides of the slots 10, 11 containing the reinforcement members 12, 13 thereby further reducing the resistance against cracking along the slots 10, 11, also along the relatively deep slots 11.

The matrix material of the covering layer 20 preferably has an elongation at break of at least 250% and more preferably of at least 300% at 24° C. (ASTM D412) and a hardness of at least 60 or 70 and at most 120 and more preferably at most 110 Shore A or at least 25 or 30 and at most 60 and preferably at most 50 Shore D (ASTM D2240). The composite material may for instance be an elastomeric substance of aromatic isocyanate resin reacted with amine prepolymers having a tensile strength of at least 12 MPa at 24° C. (ASTM D412).

Because the matrix material of a composite layer covering a surface of the wall is relatively soft and has a large elongation at break, it can accommodate relatively large deformations of the wall, without debonding from the masonry. Thus, even if the wall deforms to an extent that some cracking occurs, the composite layer effectively holds the wall together so that complete collapse of the wall is counteracted. Such a failure mode in which complete collapse or other failure of a wall occurs only at loads much larger than loads at which first cracks occur is of particular advantage for avoiding casualties in the event of an earthquake. It is noted that although providing such a covering layer is particularly advantageous when covering deep passageways that are open on the side of a wall surface, a covering layer with a matrix material that is relatively soft and has a large elongation at break is also advantageous if no passageways are provided or if passageways are provided on the first side of the midplane only.

Figure 2:
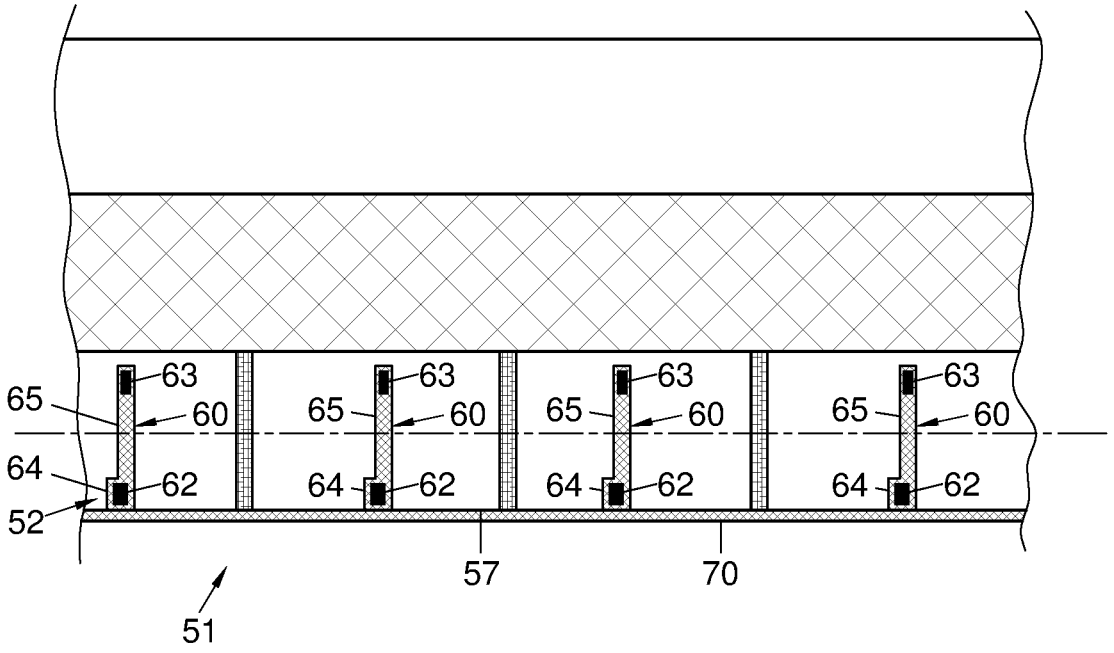
FIG. 2 is a horizontal cross-sectional view of a portion of a second example of a wall according to the invention.

In FIG. 2, a second example of a wall according to the invention is shown in the form of a different reinforcement of an otherwise identical cavity wall 51 with an inner wall 52.

In this example, the reinforcement members 62 of the first group are each arranged in a slot 60 in which also a reinforcement member 63 of the second group is arranged. The reinforcement members 62 of the first group are arranged closer to an open side of the respective slot 60 than the reinforcement members 63 of the second group arranged in the respective slots 60. This allows arranging a reinforcement member 62 of the first group and a reinforcement member 63 of the second group in each slot 60, so that no separate slots have to be cut for each reinforcement member. Accordingly, the reinforcement can be applied with less cutting and less adhesive substance has to be inserted into the slots.

The slots 60 each have a first portion 64 on the first side of the midplane 59 having a first width and a second portion 65 on the second side of the midplane 59 having a second width, the first width being larger than the second width and the reinforcement members 62 of the first group arranged in the slots 60 each have a width larger than the second width. This reliably prevents the reinforcement members 62 of the first group from being inserted into the slots 60 too deeply.

Also in this example a composite covering layer 70 has been provided which mutually fixes wall portions on opposite sides of the deep slots 60, so that it counteracts cracking along the slots 60.

Figure 3:
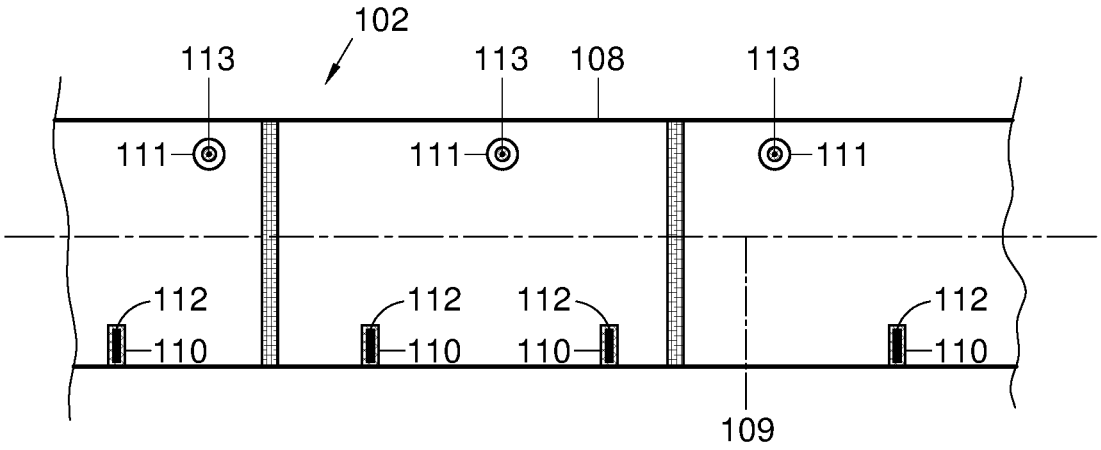
FIG. 3 is a horizontal cross-sectional view of a portion of a third example of a wall according to the invention.

In FIG. 3, an example of a single wall 102 according to the invention is shown. This may for instance be a load bearing internal wall to the second wall surface 108 of which implements like a kitchen and or bathroom equipment and tiles (not shown) are applied. As the walls according to the previously described examples, also this wall has reinforcement members 112 on a first side of a midplane 109, which are arranged in slots 110 that are open on the side of the first wall surface 107. The reinforcement members 113 of the second group on the second side of the midplane 109 are arranged in passageways in the form of bores 111. The bores 111 have been drilled approximately parallel to the second wall surface 108. This requires the top or bottom (or lateral side if the bores are oriented horizontally) of the wall 102 to be accessible for drilling. Accordingly, reinforcement in accordance with this example may for instance be provided when building a new building, the holes 111 and reinforcement members 113 of the second group being provided preferably prior to positioning a floor or roof panel on top of the wall 102. However, reinforcement according to this example may also be installed by drilling through a floor or roof panel resting on top of the wall 102 or if for instance local portions of roofing above the wall 102 can be removed temporarily to provide access to the top of the wall. An advantage of providing the passageways 111 for holding the reinforcement members 113 on the second side of the midplane 109 in the form of bores 111 is that no joints over the full height or almost the full height of the wall 102 are made, which is advantageous for maintaining the structural integrity of the wall 102. While the passageways 111 for holding the reinforcement members 113 on the second side of the midplane 109 in the form of bores 111, the passageways 110 for holding the reinforcement members 112 on the first side of the midplane 109 are provided in the form of slots 110, which are easier to make than bores and can therefore be provided at lower costs.

The reinforcement members are preferably of fibre reinforced plastic, with fibres predominantly oriented in the longitudinal direction. Such reinforcement members are flexible slats, battens or rod having some stiffness which facilitates handling and installation in the passageways, in particular if the passageways are provided in the form of bores into which the reinforcement members have to be inserted in axial direction. Also, such fibre reinforced plastic members can be combined with a relatively pasty adhesive substance, because impregnation of the fibres by the adhesive substance is not required. Filling the remaining space in the passageways with a pasty substance facilitates filling the remaining space in the passageways. It is however also possible to provide the reinforcement members in the form of fibre material that is introduced into the passageways, where it is combined with matrix material to form a composite reinforcement member or to provide the reinforcement members in the form of prepregs of which the matrix material is cured after installation in the passageways. These options do for instance allow the fibre material to be inserted from a roll.

In the present examples, at least some of the reinforcement members 12, 13, 62, 63, 112 are battens, having a batten thickness in a batten thickness direction and a batten width in a batten width direction perpendicular to the batten thickness direction. The batten thickness is smaller than the batten width and the battens are arranged in the slots with the batten width direction oriented in a slot depth direction perpendicular to the first wall surface 7, 57, 107, so that only relatively narrow slots have to be cut. This is particularly advantageous for the slots 11, 61 extending from the first wall surface 7, 57 to the second side of the midplane 9, 59. Also, the surface area of the reinforcement members facing opposite slot wall surfaces is relatively large, so that a strong adherence of the reinforcement members 12, 13, 62, 63, 112 relative to the masonry material of the wall 2, 52, 102 is achieved.

For obtaining a particularly effective reinforcement of a wall against oscillating bending loads, it is preferred that the reinforcement members of the first group are each arranged fully on the first side of the midplane and the reinforcement members of the second group of reinforcement members group are each arranged fully on the second side of the midplane.

The invention allows reinforcing a masonry wall of an existing building or of a building under construction in a particularly simple and low cost manner and particularly suitable to be applied to buildings risking to be subjected to earthquakes as a result of human intervention, such as extraction of oil and gas with or without fracking. In such areas, buildings are typically not constructed to withstand earthquakes because historically, such earthquakes have not occurred in these areas, but an urgent need has arisen to reinforce a large number of buildings in a relatively short span of time, to reduce the risk of casualties and irreparable damage, in particular to historic buildings.

Reinforcing a wall in accordance with the invention only involves making a plurality of passageways in the wall by removing wall material, the passageways including slots, which are easy to cut and the slots are open horizontally to the first side of the wall only. Thus, the wall needs to be accessible from one side only and after completing the reinforcement, restoring the external appearance of the wall only has to be carried out on the wall surface on one side of the wall.

Because the reinforcement members include a first group of reinforcement members each having a centre line on the first side of the midplane and a second group of reinforcement members each having a centre line on the second side of the midplane, a particularly effective reinforcement against oscillating bending loads is achieved. Nevertheless, because the second group of reinforcement members is arranged in passageways located spaced from the second wall surface, the second wall surface does not have to be accessible and is left unaffected by installing the reinforcement, so that finishing of the second wall surface after installing the reinforcement is not necessary.

Embedding the reinforcement members in the passageways is achieved in a simple manner by injecting an adhesive substance into the passageways, the adhesive substance bonding to each of the reinforcement members and to an inner surface of the passageway in which the reinforcement member is provided.

Several features have been described as part of the same or separate embodiments. However, it will be appreciated that the scope of the invention also includes embodiments having combinations of all or some of these features other than the specific combinations of features embodied in the examples.

The invention claimed is:

1. A wall of a building, wherein:

the wall is a masonry wall built from individual units laid in and bound together by mortar;

a plurality of passageways is provided in at least an inner or outer face of said wall, the passageways each being elongated in a longitudinal direction;

at least one reinforcement member is provided in each of said passageways, the reinforcement members being elongated in the longitudinal direction of the passageways and arranged parallel to a midplane of said wall on at least a first side of said midplane or a second side of said midplane opposite to said first side;

the reinforcement members in the passageways are each embedded in an adhesive substance, the adhesive substance being bonded to each of the reinforcement members and to an inner surface of the passageway in which the reinforcement member is provided; and said adhesive substance has an elongation at break of at least 40% as measured in accordance with DIN 53544 and a hardness at room temperature of at most 100 Shore A.

2. The wall according to claim 1, wherein said adhesive substance has an elongation at break of at least 50% as measured in accordance with DIN 53544.

3. The wall according to claim 1, wherein said adhesive substance has a hardness at room temperature of at most 90 Shore A.

4. A masonry wall of a building built from individual units laid in and bound together by mortar, the wall further comprising a stabilizing layer covering a vertical surface of at least an inner or outer face of the mutuality bound units of said wall, said stabilizing layer being composed of a matrix material and fibres embedded in the matrix material, the matrix material adhering to the first wall surface, wherein the matrix material has an elongation at break of at least 250% at 24° C. as measured in accordance with ASTM D412 and a hardness of at most 120 Shore A or at most 60 Shore D as measured in accordance with ASTM D2240.

5. The wall according to claim 4, wherein:

a plurality of passageways is provided in said wall, the passageways each being elongated in a longitudinal direction;

at least one reinforcement member is provided in each of said passageways, the reinforcement members being elongated in the longitudinal direction of the passageways;

the reinforcement members in the passageways are each embedded in an adhesive substance, the adhesive substance being bonded to each of the reinforcement members and to an inner surface of the passageway in which the reinforcement member is provided; and said adhesive substance has an elongation at break of at least 40% as measured in accordance with DIN 53544 and a hardness at room temperature of at most 100 Shore A.

6. The wall according to claim 5, wherein said adhesive substance has an elongation at break of at least 50% as measured in accordance with DIN 53544.

7. The wall according to claim 5, wherein said adhesive substance has a hardness at room temperature of at most 90 Shore A.

8. The masonry wall according to claim 4, wherein the matrix material has an elongation at break of at least 300% at 24° C. as measured in accordance with ASTM D412.

9. The masonry wall according to claim 4, wherein the matrix material has a hardness of at most 110 Shore A or at most 50 Shore D as measured in accordance with ASTM D2240.

* * * * *